US006238042B1

(12) United States Patent
Kobayashi et al.

(10) Patent No.: US 6,238,042 B1
(45) **Date of Patent: *May 29, 2001**

(54) INK CARTRIDGE FOR INK JET PRINTER AND METHOD OF CHARGING INK INTO SAID CARTRIDGE

(75) Inventors: Takao Kobayashi; Satoshi Shinada; Kiyofumi Usui; Shoichi Hiraide; Kazuo Koshino; Hisashi Miyazawa; Seiji Mochizuki; Yoshinori Miyazawa; Takashi Suzuki; Eiko Yanagida, all of Suwa (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/529,149

(22) Filed: Sep. 15, 1995

Related U.S. Application Data

(63) Continuation-in-part of application No. 08/488,534, filed on Jun. 7, 1995, which is a continuation-in-part of application No. 08/357,639, filed on Dec. 16, 1994.

(30) Foreign Application Priority Data

Sep. 16, 1994 (JP) ..... 6-248518
Sep. 11, 1995 (JP) ..... 7-258102

(51) Int. Cl.[7] ..... B41J 2/175
(52) U.S. Cl. ..... 347/86
(58) Field of Search ..... 347/85–87

(56) References Cited

U.S. PATENT DOCUMENTS

| | | | |
|---|---|---|---|
| 2,585,647 | 2/1952 | Gordon | 118/265 |
| 2,747,543 | 5/1956 | Navikas | 118/264 |
| 3,018,756 | 1/1962 | Kilham | 118/264 |
| 3,097,597 | 7/1963 | Visser | 101/364 |
| 3,101,667 | 8/1963 | Siegel | 101/364 |
| 3,441,950 | 4/1969 | Miller | 346/140 |

(List continued on next page.)

FOREIGN PATENT DOCUMENTS

| | | | |
|---|---|---|---|
| 2546835 | 4/1977 | (DE) . | |
| 0 261 764 A1 | 3/1988 | (EP) . | |
| 424133 * | 4/1991 | (EP) | 341/87 |
| 529625 | 3/1993 | (EP) . | |
| 0 536 980 A2 | 4/1993 | (EP) . | |
| 0581 531 A1 | 7/1993 | (EP) . | |
| 0 581 531 A1 * | 7/1993 | (EP) | 347/85 |
| 0 553 535 A1 | 8/1993 | (EP) . | |
| 562733 * | 9/1993 | (EP) | 347/87 |

(List continued on next page.)

*Primary Examiner*—John Barlow
*Assistant Examiner*—Craig A. Hallarcher
(74) *Attorney, Agent, or Firm*—Stroock & Stroock & Lavan LLP

(57) ABSTRACT

An ink cartridge including: an ink chamber for retaining liquid ink; a foam chamber maintained in fluid communication with the ink chamber through a communication hole. An ink supply port for supplying ink from a porous body accommodated in the foam chamber to a recording head is provided. The portion of the foam body confronting the ink supply port is compressed by the ink supply port. The ratio between the amount of ink initially charged in the ink chamber and that of ink absorbed in the porous body is in the range from 1:1 to 1:3. When a cartridge uses more than one color of ink for printing in color, a plurality of foam and ink cartridges are used. The cartridge is filled under reduced pressure while the interior of the cartridge is further evacuated before filling with ink.

38 Claims, 5 Drawing Sheets

U.S. PATENT DOCUMENTS

| | | | |
|---|---|---|---|
| 3,599,566 | 8/1971 | Fish | 101/364 |
| 3,967,286 | 6/1976 | Andersson et al. | 346/140 |
| 4,017,871 | 4/1977 | Hubbard | 346/140 |
| 4,095,237 | 6/1978 | Amberntsson et al. | 346/140 |
| 4,183,030 | 1/1980 | Kaieda et al. | 346/140 |
| 4,183,031 | 1/1980 | Kyser et al. | 346/140 R |
| 4,194,846 | 3/1980 | Zerillo | 400/124 |
| 4,272,773 | 6/1981 | Halasz | 346/140 |
| 4,279,519 | 7/1981 | Shiurila | 400/124 |
| 4,336,767 | 6/1982 | Wada | 118/264 |
| 4,353,654 | 10/1982 | Shiurila | 400/124 |
| 4,368,478 | 1/1983 | Koto | 346/140 |
| 4,400,102 | 8/1983 | Shiurila et al. | 400/124 |
| 4,403,874 | 9/1983 | Payne et al. | 400/124 |
| 4,456,393 | 6/1984 | Gomi et al. | 400/124 |
| 4,463,362 | 7/1984 | Thomas | 347/86 |
| 4,484,827 | 11/1984 | Price, Jr. | 401/205 |
| 4,506,277 | 3/1985 | Terasawa | 346/140 |
| 4,511,906 | 4/1985 | Hara | 346/140 |
| 4,553,865 | 11/1985 | Ikeda et al. | 400/124 |
| 4,630,758 | 12/1986 | Mutoh | 222/189 |
| 4,631,558 | 12/1986 | Hara | 346/140 |
| 4,695,824 | 9/1987 | Tazaki | 346/140 |
| 4,719,479 | 1/1988 | Kyogoku | 346/140 |
| 4,794,409 | 12/1988 | Cowger et al. | 346/140 |
| 4,855,762 | 8/1989 | Suzuki | 346/140 |
| 4,967,207 | 10/1990 | Ruder | 347/87 |
| 4,968,998 | 11/1990 | Allen | 347/87 |
| 4,969,759 | 11/1990 | Suzuki et al. | 400/124 |
| 5,056,433 | 10/1991 | Murphy et al. | 101/364 |
| 5,070,346 | 12/1991 | Mochizuki et al. | 347/86 |
| 5,119,115 | 6/1992 | Buat et al. | 346/140 |
| 5,156,470 | 10/1992 | Suzuki et al. | 400/124 |
| 5,156,471 | 10/1992 | Suzuki et al. | 400/124 |
| 5,156,472 | 10/1992 | Suzuki et al. | 400/124 |
| 5,156,473 | 10/1992 | Suzuki et al. | 400/124 |
| 5,158,377 | 10/1992 | Suzuki et al. | 400/124 |
| 5,174,665 | 12/1992 | Suzuki et al. | 400/124 |
| 5,221,148 | 6/1993 | Suzuki et al. | 400/124 |
| 5,255,019 | 10/1993 | Mochizuki et al. | 346/140 |
| 5,280,300 | 1/1994 | Fong et al. | 346/1.1 |
| 5,289,212 | 2/1994 | Carlotta | 346/140 |
| 5,328,279 | 7/1994 | Suzuki et al. | 400/124 |
| 5,420,625 | 5/1995 | Dieti et al. | 347/85 |
| 5,421,658 | 6/1995 | Suzuki et al. | 400/124 |
| 5,477,963 | 12/1995 | Mochizuki et al. | 206/701 |
| 5,488,401 | 1/1996 | Mochizuki et al. | 347/86 |
| 5,509,140 * | 4/1996 | Koitabashi et al. | 347/87 |
| 5,633,667 * | 5/1997 | Miyazawa | 347/86 |

FOREIGN PATENT DOCUMENTS

| | | | |
|---|---|---|---|
| 605183 | 7/1994 | (EP) . | |
| 0 624 475 A2 | 11/1994 | (EP) . | |
| 0 625 424 A2 | 11/1994 | (EP) . | |
| 0640 484 A2 | 1/1995 | (EP) . | |
| 0 640 482 A2 | 3/1995 | (EP) . | |
| 0 650 484 | 3/1995 | (EP) | B41J/2/175 |
| 0 655 108 A2 | 8/1995 | (EP) . | |
| 2229320 | 12/1974 | (FR) . | |
| 42874 | 3/1980 | (JP) . | |
| 55-166267 | 12/1980 | (JP) . | |
| 185168 | 11/1982 | (JP) . | |
| 89377 | 5/1983 | (JP) . | |
| 188670 | 11/1983 | (JP) . | |
| 59-68985 | 5/1984 | (JP) . | |
| 61-022952 | 1/1986 | (JP) . | |
| 188261 * | 7/1990 | (JP) | 347/85 |
| 204052 * | 8/1990 | (JP) | 347/87 |
| 6015841 | 1/1994 | (JP) . | |
| 6-126976 | 5/1994 | (JP) . | |

* cited by examiner

INK CARTRIDGE FOR INK JET PRINTER AND METHOD OF CHARGING INK INTO SAID CARTRIDGE

CROSS REFERENCE TO RELATED APPLICATION

This is a continuation-in-part application of application Ser. No. 08/488,534 filed Jun. 7, 1995, entitled INK-SUPPLIED PRINTER HEAD AND INK CONTAINER, which is a continuation-in-part application of application Ser. No. 08/357,639 filed on Dec. 16, 1994.

BACKGROUND OF THE INVENTION

The invention relates generally to an ink cartridge and a method of charging ink into the cartridge and more specifically to an ink cartridge and a method of charging ink into the cartridge suitable for an ink jet printer in which a carriage carries an ink jet recording head and an ink cartridge and in which the ink is replenished by replacing the cartridge.

In an ink jet printer in which the carriage carrying the ink jet recording head also carries an ink container, measures are taken to prevent pressure fluctuations of the ink due to the oscillation of the ink caused by the movement of the carriage, and defective printing due to foaming. That is, as proposed in Laid-open European Patent Publication No. 581531, the ink container of an ink jet printer is divided into two regions. A porous body is accommodated in a region on the recording head side, and ink is contained in the other region.

Such structure is advantageous in obviating inconvenience caused by the oscillation of the ink to a possible extent since the ink is supplied to the recording head through the porous body.

However, the porous body functions merely as a filter, and this means that it is the ink within the ink chamber, not the ink in the porous body, that substantially is the remaining amount of ink. Therefore, when the ink within the ink chamber runs out, the printer can no longer print. In addition, in a color printer or the like that uses inks of a plurality of colors, the amounts of remaining ink vary from one ink chamber to another even if the inks of all the colors have been supplied simultaneously since all the inks are not necessarily consumed equally in color printing. As a result, ink remains within the cartridge in liquid form when the cartridge is replaced, and when the cartridge is discarded the ink may leak out and contaminate the environment. In addition, the user may unnecessarily become apprehensive over unbalanced consumption of ink and the possibility of one of the colors running out.

SUMMARY OF THE INVENTION

Generally speaking in accordance with the invention, an ink cartridge for an ink jet printer is provided. The ink cartridge includes: an ink chamber for retaining liquid ink; a foam chamber maintained in fluid communication with the ink chamber through a communication hole; and an ink supply port formed in a wall of the ink cartridge. A porous body for absorbing ink is accommodated in the foam chamber. The ink cartridge supplies the ink within the ink chamber to a recording head via the porous body and the ink supply port. The porous body is compressed in at least a region of the porous body confronting the ink supply port so that the compression ratio in the vicinity of the ink supply port becomes high. The ratio between the amount of ink initially charged in the ink chamber and that of ink absorbed in the porous body is in the range from 1:1 to 1:3.

Accordingly, it is an object of the invention to provide an ink cartridge capable of avoiding environmental pollution and unnecessary apprehension on the part of the user by totally absorbing all of the ink remaining in the cartridge in liquid form at the time of replacing the ink cartridge in the porous body.

Another object of the invention is to provide an ink cartridge capable of preventing leakage of the ink to the outside by causing all the ink to be absorbed in the porous body at the time of discarding the cartridge.

A further object of the invention is to provide an ink cartridge capable of relating the timing at which the ink within the ink chamber runs out to an indication to the user of a "near end" condition.

Yet another object of the invention is to propose a method of charging the ink suitable for the aforementioned ink cartridge.

Still other objects and advantages of the invention will in part be obvious and in part be apparent from the specification.

The invention accordingly comprises the several steps and the relation of one or more of such steps with respect to each of the others and the apparatus embodying features of construction, combinations of elements and arrangement of parts which are adapted to effect such steps, all as exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which:

FIGS. 2*a* and 2*b* are diagrams respectively showing the structure of the upper surface of a foam chamber of a frame body, in which FIG. 2*a* shows a condition before a seal is bonded; and FIG. 2*b* shows a condition after the seal has been bonded;

DETAILED DESCRIPTION OF THE PREFERRED EMBODIMENTS

Figure 1A:
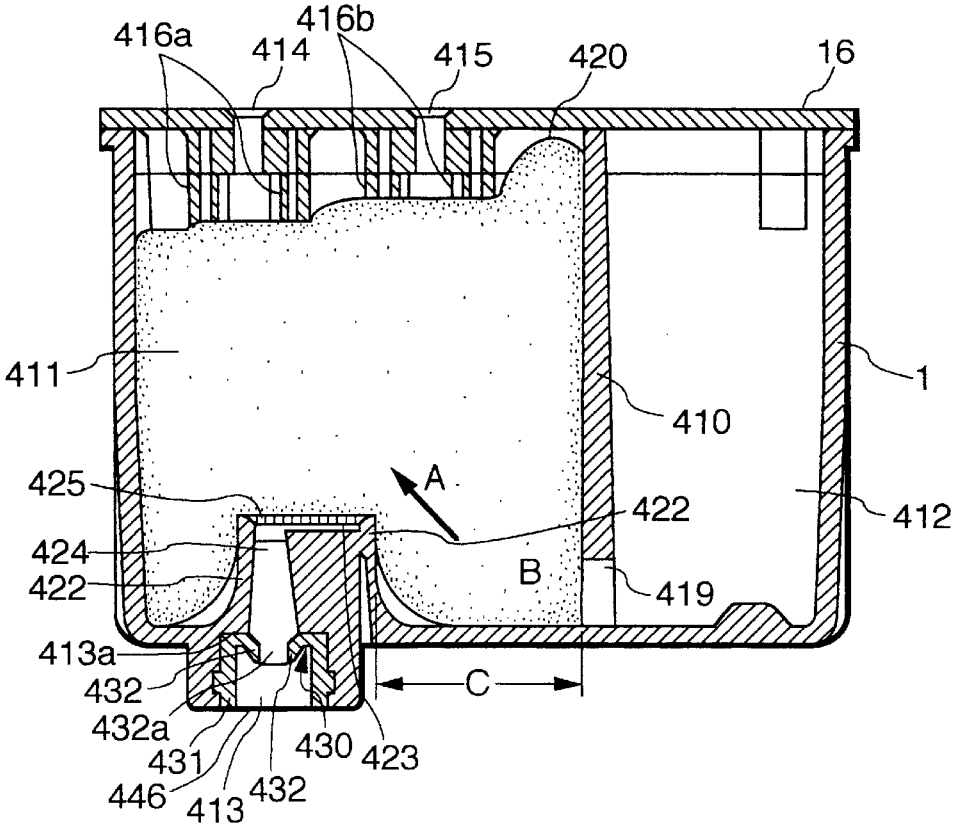
FIGS. 1*a* and 1*b* are cross sectional views respectively showing an ink cartridge depicted in accordance with a first embodiment of the invention.
Figure 1B:
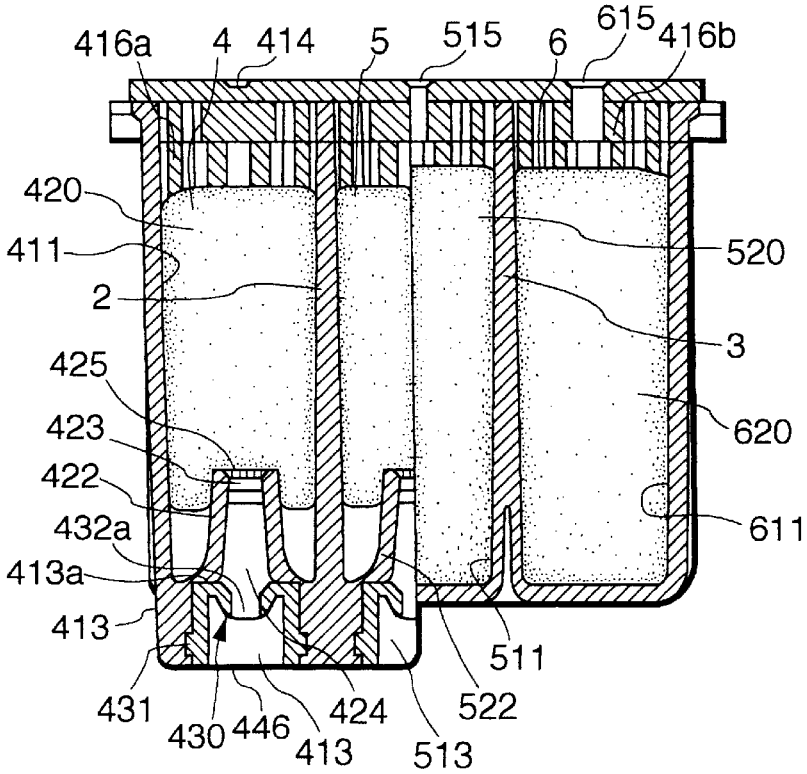

Referring first to FIGS. 1*a* and 1*b*, an ink cartridge constructed in accordance with a first embodiment of the invention is shown. In FIGS. 1*a* and 1*b* reference numeral 1 denotes a container main body, which is divided into three chambers 4, 5, 6 by partition plates 2, 3. Each of the chambers 4, 5, 6 is further divided into a foam chamber and an ink chamber by a partition, only foam chamber 411, ink chamber 412 and partition 410 of chamber 4, being visible in FIG. 1*a*. The remaining chambers 5 and 6 are essentially identical to chamber 4, foam chambers 511 and 611 of chambers 5 and 6 being visible in FIG. 1*b*. Each foam chamber 411, 511, 611 is designed to accommodate a respective porous body 420, 520, 620, made of an elastic material that is suitable for absorbing ink, and each ink chamber as exemplified by ink chamber 412 is designed to directly contain liquid ink. The volumes of the porous bodies 420, 520, 620 before insertion in the respective foam chambers 411, 511, 611 are larger than the capacity of the respective foam chambers 411, 511 and 611, so that each of the porous bodies 420, 520 or 620 is accommodated in the respective foam chamber 411, 511 or 611 in a compressed condition.

An ink supply port shaped to receive an ink supply needle of a recording head is arranged at the lower end of each of the respective foam chambers 411, 511 and 611, ink supply ports 413 and 513 of foam chambers 411 and 511 respectively being visible in FIG. 1*b*. The opening of the container main body 1 is sealed with a cover member 16 that has exhausting through holes 414, 514 and 614 and ink injecting through holes 415, 515 and 615 at positions confronting the respective foam chambers 411, 511 and 611 (see FIGS. 1*a*, 1*b*, 2*a*, 2*b*).

The remainder of the features will be described with respect to chamber 4, but it is understood that parallel structure exists in both chambers 5 and 6. Projections 416*a* and 416*b* are formed so as to surround through holes 414 and 415, respectively at regions on the bottom surface of cover member 16 confronting foam chamber 411. These projections 416*a* and 416*b* bias porous body 420 onto the bottom surface of the corresponding foam chamber 411 in which ink supply port 413 is formed.

Projections 416*a* which confront ink supply port 413 are formed so as to be longer than projections 416*b* so that the lower end of projection 416*a* is positioned lower than that of projection 416*b*. This allows porous body 420 in the vicinity of ink supply port 413 to be compressed at the highest pressure.

On the bottom of foam chamber 411 is an inwardly projected portion 422 that compresses porous body 420 conjointly with cover member 16. At an upper portion of projected portion 422 is a recessed portion 423 and one end of through hole 424. Recessed portion 423 forms an empty space with a predetermined open area, and through hole 424 communicates with recessed portion 423 at one end thereof and communicates with a packing member 430 (to be described later) at the other end thereof.

A filter 425 is fixed to the top of recessed portion 423. Filter 425 has a 15×30 mm ink passage area. Packing member 430 is attached to the lower end of through hole 424. Packing member 430 is made of an elastic material and has the uppermost opening tapered downward so as to have its upper opening wider than its lower opening.

Figure 4:
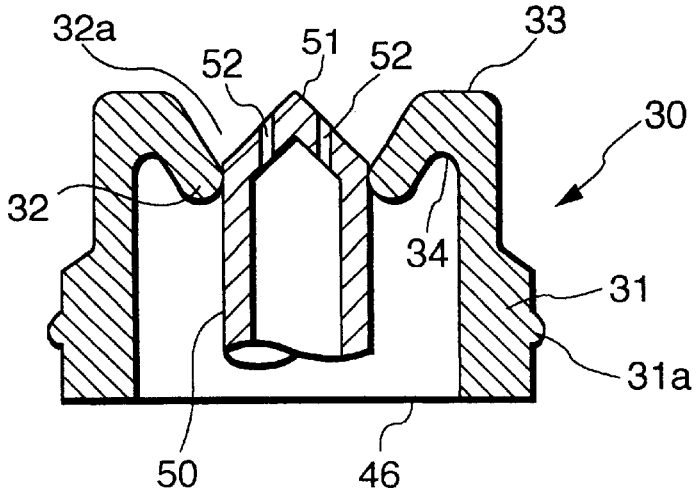
FIG. 4 is a cross-sectional view showing how a packing member of the ink cartridge is fitted with an ink supply needle when the ink cartridge is attached to a recording head.

Reference is now made to FIG. 4, which depicts packing member 30 similar to packing member 430. As shown in FIG. 4, packing member 30 is made of an elastic material such as rubber and has a tapered portion 32 so as to be funnel-shaped. A cylindrical portion 31 has walls which are thicker than the other walls of packing member 30. An annular projection 31*a* is formed in the outer periphery of cylindrical portion 31 to be received in a corresponding groove on the wall of the ink supply port to hold the packing member in place. Cylindrical portion 31 is coupled through a thin-walled connecting portion 34 that is connected to the large diameter portion of tapered portion 32 so that packing member 30 is fitted with ink supply port 13 so that the upper annular end 33 of tapered portion 32 abuts the confronting innermost stepped portion of the of ink supply port such as stepped portion 413*a* (FIG. 1*a*). Further, the inner diameter of a lower opening 32*a* of tapered portion 32 is set to such a value as to be slightly smaller than the outer diameter of an ink supply needle 50.

As a result of this construction, packing member 30 is reliably retained in the ink supply port by cylindrical portion 31, and the upward movement of annular upper end 33 of packing member 30 is blocked by the corresponding innermost stepped portion of the ink supply port, such as stepped portion 413*a*. Therefore, packing member 30 becomes firmly fixed to the ink supply port when attaching and detaching the ink supply needle 50 thereto and therefrom. Further, since tapered portion 32, which ensures airtightness with respect to ink supply needle 50, is fixed to the ink supply port by thin-walled connecting portion 34, tapered portion 32 is movable to some extent without being so deformed as to break the airtight seal with ink supply needle 50. As a result, tapered portion 32 can be maintained in airtight contact with respect to ink supply needle 50 while absorbing a relative positional displacement of the ink supply body with respect to ink supply needle 50.

Each partition, such as partition 410 dividing a foam chamber such as foam chamber 411, from an ink chamber such as ink chamber 412 has a gas-liquid separating communication hole such as communication hole 419, visible in FIG. 1*a*, which is an elongated hole extending a predetermined height directly from the bottom of the container. Each gas-liquid separating communication hole preferably extends over only a portion of the width of the partition. Discussion will now continue with respect to compartment 4, keeping in mind that compartments 5 and 6 have parallel structure. Porous body 420 is accommodated in foam chamber 411 so that part of porous body 420 is in contact with communication hole 419 and so that porous body 420 is elastically compressed by the portion of partition wall 410 adjacent communication hole 419 to some extent.

In use, when a sufficient quantity of ink is consumed during printing by passing through ink supply port 413 as needed from porous body 420, ink passes from ink chamber 412 through gas-liquid replacement communication hole 419 and air passes from exhausting through hole 414 (which acts as an ambient air vent as more particularly described below), through porous body 420, through gas-liquid replacement communication hole 419 to ink chamber 412. Porous body 420 is compressed so as to be raised about 5 to 10 mm from the bottom surface of container 1 by projected portion 422. As a result, porous body 420 receives a tensile force acting in a direction indicated by an arrow A in FIG. 1*a*, which in turn decreases the rate of compression in a region B close to communication hole 419, thereby making it likely that the replacement of the air within the communication hole 419 with the ink within the ink chamber 412 will be affected.

To obviate this problem, the embodiment of the invention is designed so that porous body 420 comes in intimate contact with communication hole 419 reliably by setting a distance C between projected portion 422 and communication hole 419 to not less than 1.5 times the height of projected portion 422.

As a result of this design, porous body 420 is most highly compressed in the vicinity of filter 425 on top of the projected portion 422 and less compressed toward communication hole 419. Thus, the capillary force gradually increases accordingly toward the top of projected portion 422 from communication hole 419, thereby allowing the ink within ink chamber 412 to be introduced to the through hole 424 reliably.

Figure 2A:
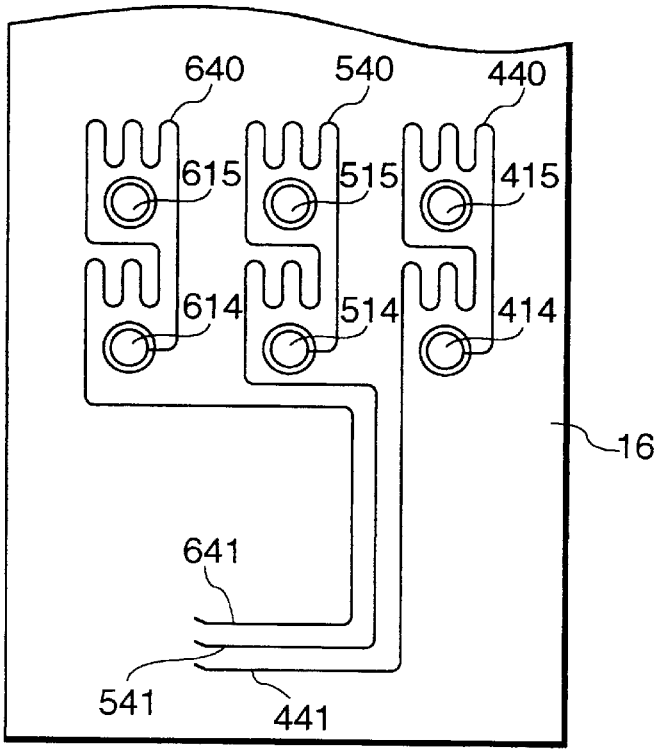
Figure 2B:
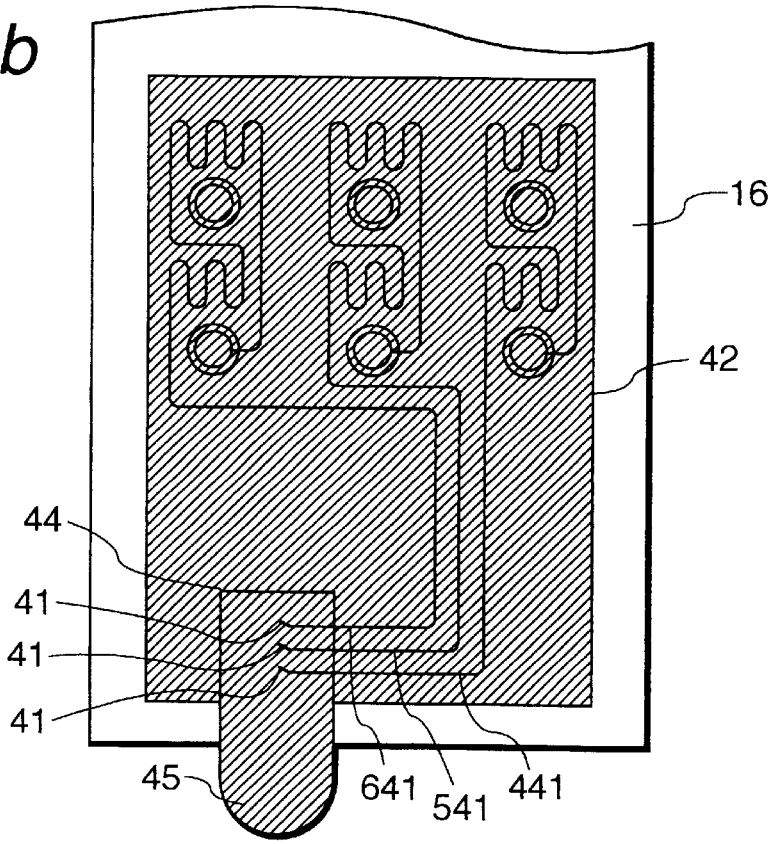

Reference is now made to FIGS. 2*a* and 2*b* which depict an outer view of an example of cover member 16. In FIG. 2*a* and 2*b*, reference numerals 414, 514 and 614 and 415, 515 and 615 denote the aforementioned through holes that are formed in the region under which porous bodies 420, 520 and 620 are respectively contained. One group of the through holes, through holes 414, 514 and 614 in this example are connected to air communication ports 441, 541, 641 through meandering grooves 440, 540, 640.

These grooves 440, 540, 640 form capillary tubes when a seal 42 covering through holes 414, 514 and 614, and 415, 515 and 615 as well as the air communication ports 441, 541 and 641 has been bonded to cover 16 after an ink injecting operation (to be described later) has been performed. A cutting line 44, shown in FIG. 2*b*, is provided in advance at a portion of seal 42 close to air communication ports 441, 541 and 641, so that the air communication ports can be exposed simply by pulling up a tongue strip 45, to provide ambient air to the interior of the foam chambers while minimizing evaporation of ink therefrom.

Figure 3:
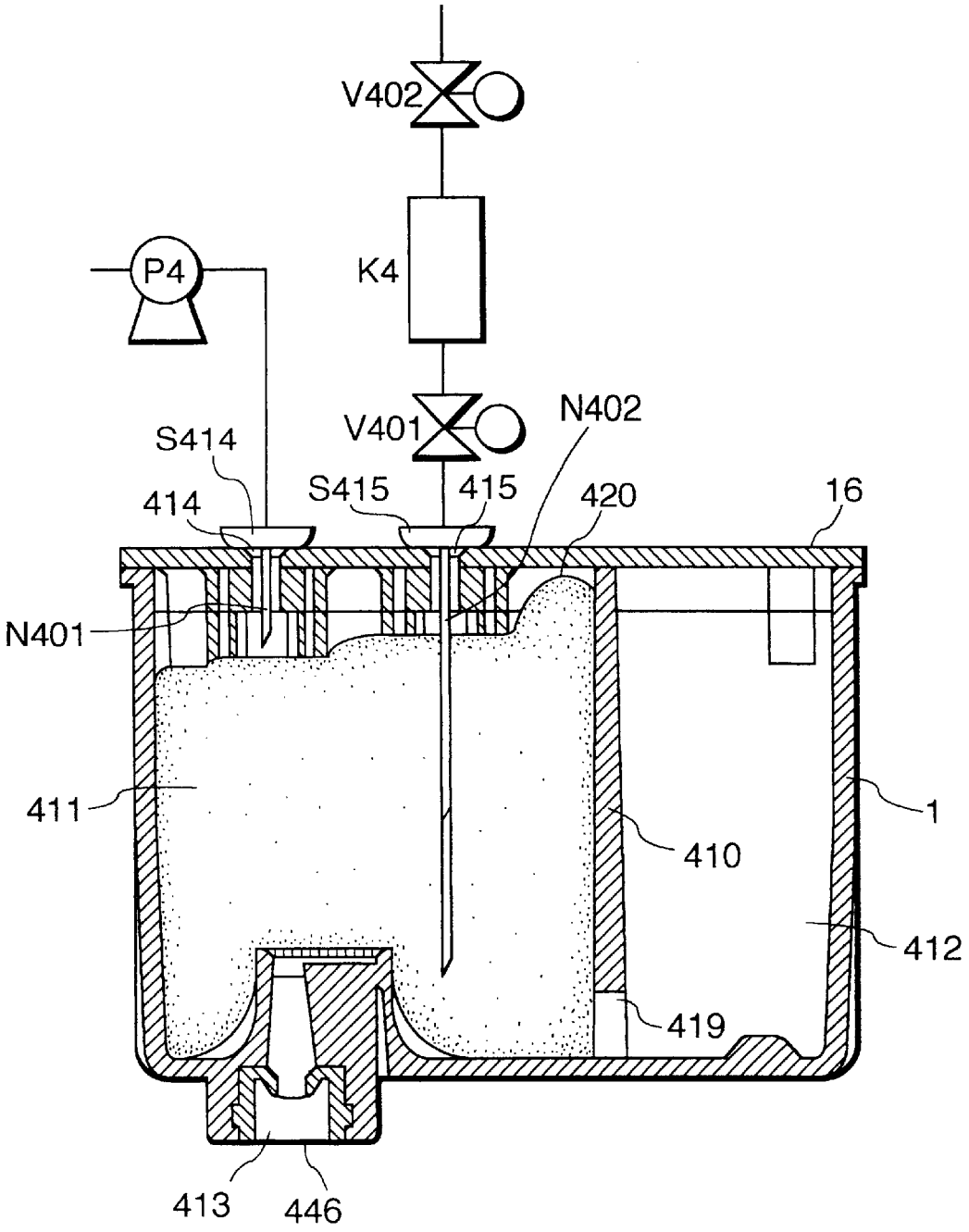
FIG. 3 is a diagram and cross-sectional view illustrative of an exemplary method of charging ink into the cartridge.

In order to fill each chamber 4, 5 and 6 of the thus designed cartridge, first the ink supply ports are sealed by a film, such as film 446 sealing ink supply port 413, as shown in FIG. 3 (depicting only compartment 4, which is parallel in structure to compartments 5 and 6). Then one injecting needle N401 and the other injecting needle N402 are inserted while keeping exhausting through hole 414 and ink injecting through hole 415 airtight using sealing members S414, S415. Injecting needle N401 is inserted into the upper space of foam chamber 411 above porous body 420, and injecting needle N402 is inserted toward the bottom of foam chamber 411 through porous body 420 so as to be as close to communication hole 419 as possible. An exhauster P4 is connected to injecting needle N401, and the other injecting needle N402 is closed by a valve V401.

When exhauster P4 is operated under this condition, foam chamber 411 and ink chamber 412 are further evacuated. When these chambers 411 and 412 are evacuated to a predetermined pressure, the exhauster is stopped to hold a predetermined pressure. Thereafter, the other injecting needle N402 is placed in fluid communication with a measuring tube K4 by opening valve V401. Then, the ink contained within measuring tube K4 is absorbed into porous body 420, and flows into ink chamber 412 via communication hole 419.

The valve V401 of the injecting needle N402 is closed when a certain amount of ink has flowed into the cartridge from the measuring tube K4, so that the exhauster P4 is released to ambient air and accordingly the foam chamber 411 and the ink chamber 412 obtain the atmospheric pressure. During this operation, the ink contained in the foam chamber 411 flows downwardly. Under this condition, the injecting needles N401 and N402 are removed from the sealed through holes 414 and 415. In this condition where the measuring tube K4 is in a decompressed condition, the valve V402 is released to allow ink to introduce and then the valve V402 is closed and the system stands by until the next ink injection operation.

When such an amount of ink as defined by the measuring tube K4 has been introduced, injecting needles N401 and N402 and sealing members S414 and S415 are removed and seal 42 is bonded to the outer surface of cover member 16 to seal through holes 414, 514 and 614 and 415, 515 and 615, meandering grooves 440, 540 and 640, and air communication ports 441, 541 and 641.

As a result, foam chamber 411 and ink chamber 412 are maintained in a low pressure (below atmospheric) state, which keeps the injected ink also in a low pressure state. Since the ink is injected into ink chamber 412 via porous body 420 in this way, the ink can be spread out into each of the tiny holes of porous body 420. In addition, the entire inside of the cartridge can be maintained in a low pressure state, which in turn prevents the pressure from excessively increasing due to an increase in temperature during storage. Hence, the ink charging rate can be improved, and the cartridge can therefore be downsized.

The thus constructed cartridge is designed to cause the throughholes 414, 514 and 614 of foam chambers 411, 511 and 611 to communicate with respective air communication ports 441, 541 and 641 through capillary tubes formed by grooves 440, 540 and 640 and seal 42 when tongue strip 45 is removed. Therefore, the cartridge can prevent leakage of the ink from the throughholes irrespective of differences in pressure with respect to the recording head, while preventing evaporation of the ink.

The above described filling step may be performed in a filling chamber maintained at below atmospheric pressure, which permits the filled foam and ink chambers to be at less than atmospheric pressure.

Referring again to FIG. 4, when an ink supply port such as ink supply port 413 of the ink cartridge is aligned with an ink supply needle 50 of the recording head and pushed thereon under this condition, a tapered portion 51 of ink supply needle 50 abuts the hole of the packing member while passing through a film 46. Tapered portion 32 of packing member 30, which is funnel shaped to be gradually expanded upward, allows ink supply needle 50 to pass therethrough while being elastically deformed while in elastic contact with the tapered portion 51.

If ink supply needle 50 is used in such a manner as to be inserted into packing member 30, the ink supply port and ink supply needle 50 can be sealed reliably. That is, even if the ink supply needle of the recording head is slightly displaced horizontally with respect to the center of packing member 30, tapered portion 32 accommodates ink supply needle 50 by the elasticity thereof once the point of ink supply needle 50 has been fitted into the hole of packing member 30.

When the ink is consumed due to printing, the amount of ink in porous body 420 is reduced and as a result, the pressure is also decreased. Therefore, pressure within ink chamber 412 overcomes the ink retaining force of porous body 420 in the vicinity of communication hole 419 so that air bubbles are admitted into ink chamber 412 through communication hole 419. As a result, the pressure within ink chamber 412 is increased to aid in transferring the ink into foam chamber 411.

The ink introduced into foam chamber 411 slightly increases the ink level in foam chamber 411 when it is absorbed by porous body 420, and when the ink retaining force of porous body 420 in the vicinity of communication hole 419 reaches equilibrium with the pressure within the ink chamber 412, the flow of ink from ink chamber 412 to foam chamber 411 stops.

Figure 5:
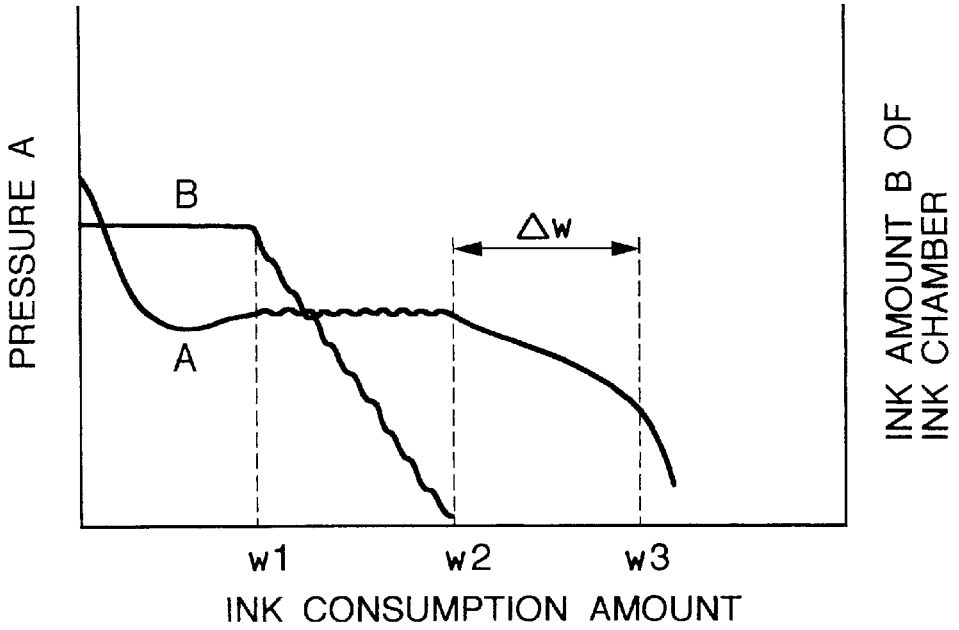
FIG. 5 is a graph showing a relationship between ink consumption, pressure, and amount of ink remaining within the ink chamber.

FIG. 5 depicts the ink levels during this process. In FIG. 5, reference character A denotes the pressure of the porous body in foam chamber 411; and reference character B, the amount of ink within ink chamber 412. As is apparent from this diagram, when the ink initially charged into porous body 420 has been consumed to a predetermined level w1 and the pressure of porous body 420 has been reduced to a predetermined value, i.e., to such an extent as to allow the pressure within ink chamber 412 to overcome the ink retaining force of porous body 420 in the vicinity of communication hole 419, the ink within ink chamber 412 gradually flows into foam chamber 411 until the ink retaining force of porous body 420 in the vicinity of communication hole 419 is restored to equilibrium with the pressure within ink chamber 412.

Therefore, although the ink within ink chamber 412 gradually decreases, the pressure of porous body 420 is maintained substantially constant, thereby allowing the ink to be supplied to the recording head under a predetermined pressure difference.

When the ink has been consumed to a predetermined level w2 by the recording head, printing can be continued with the ink that has been absorbed by porous body 420 since an amount of ink equal to that when the ink has been intermittently supplied from ink chamber 412 to foam chamber 411 still remains in porous body 420 although the ink within ink chamber 412 has been depleted. A predetermined amount of ink Δw can still be supplied to the recording head until printing can no longer be continued from the time all ink within the ink chamber 412 has been absorbed by porous body 420. To positively utilize this feature of the invention, the ratio in volume of foam chamber 411 to the ink chamber 412 is set so that the amount of ink contained in foam chamber 411 is from the same to three times that contained in ink chamber 412. When the ink has been consumed to a predetermined level w3, no more ink is supplied from porous body 420 to the printer head and no further printing will take place.

A preferred embodiment will now be described in detail hereinbelow. The liquid absorbing rate of porous body 420 is 80%. In other words, the porous body can absorb ink amounting to 80% of its volume, for example. If the ratio in volume between foam chamber 411 and ink chamber 412 is set to 2:1, then about 20% of the total amount of ink charged in the ink tank is consumed at an initial stage from foam chamber 411 (W1 of FIG. 5), about 40% of the total amount of ink charged in the ink tank is retained in porous body 420, and about 40% of the total amount of ink charged in the ink tank is retained in ink chamber 412 and is gradually absorbed into foam chamber 411 to be used up. When the ink within ink chamber 412 has been used up (W2 in FIG. 5), 40% of the total amount of ink charged still remains in foam chamber 411. Thereafter, the ink that is equivalent to 30% of the total amount of ink charged in the ink tank is consumed during printing, so that about 10% of the total amount of ink initially charged in the ink tank finally remains within foam chamber 411 after printing can no longer be performed. In this embodiment, the porous member is initially charged with about 3/2 times the amount of ink initially charged into ink chamber 412.

If container main body 1 is formed of an essentially transparent or translucent material, in the case of supplying inks of three colors out of a single cartridge, variations in ink levels within the ink chambers attributable to inconsistent ink consumption can be identified by a visual check, which in turn contributes to freeing the user from needlessly worrying about how much ink still remains in the respective ink chambers and from potentially running out of ink of a particular color. In addition, since the inks are unlikely to be present in any of the ink chambers in liquid form but rather are absorbed by the respective porous bodies at the time the used cartridge is discarded, the leakage of the inks from the cartridge can be prevented. This result can be assured if the user is alerted by means of an instruction to replace the used cartridge with a new one when all of the ink within each of the ink chambers have been supplied to their associated porous bodies. This contributes to a more environmentally sound product. Moreover, since the absence of ink within an ink chamber 412 indicates a near-end condition of the ink within the whole cartridge, the ink can be replenished readily by preparing a new cartridge in order to protect against the running out of ink.

Figure 6:
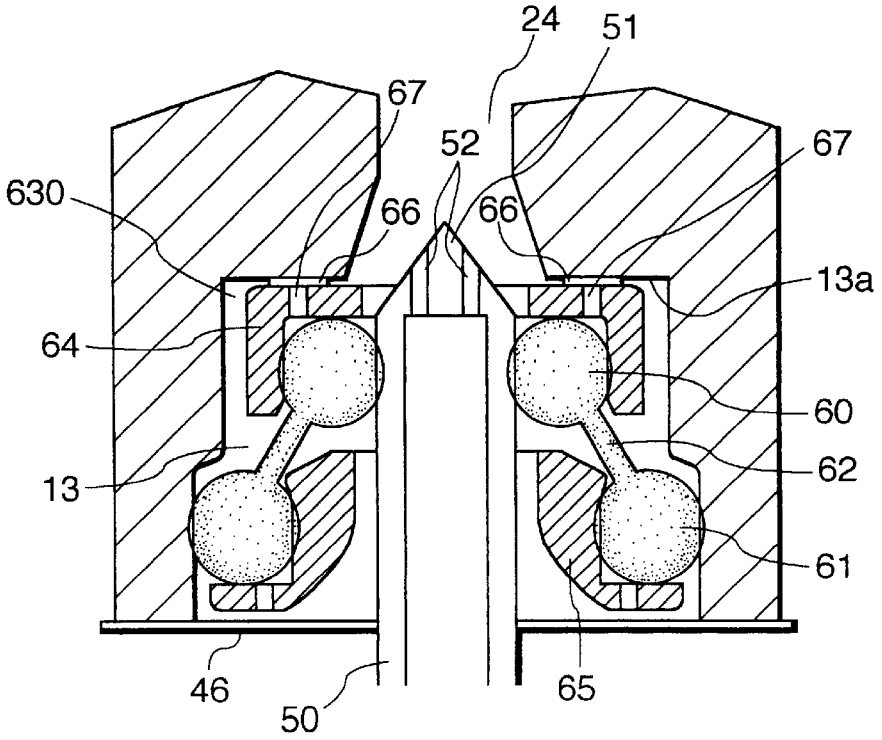
FIG. 6 and FIG. 7 are cross-sectional views respectively showing other exemplary packing members for sealing the ink supply needle.

Reference is now made to FIG. 6 which depicts an example of a packing member 630 for sealing the ink supply needle constructed in accordance with a second embodiment of the invention. Elements similar to those in the first embodiment are given like reference numerals. This packing member is characterized as having a self-aligning ring, which is made of a soft resin material and includes a ringlike needle surrounding seal 60, a ringlike port surrounding seal 61, and a thin-walled conical connecting ring 62 that connects needle surrounding seal 60 to port surrounding seal 61 so that both seals 60 and 61 are integrated with each other. Needle surrounding seal 60 has a circular cross-section whose inner diameter is slightly smaller than the outer diameter of ink supply needle 50. Port surrounding seal 61 has a circular section whose outer diameter is slightly larger than the inner diameter of ink supply port 13. Port surrounding seal 61 is arranged on the ink supply needle insertion entrance side of packing member 630.

A movable bush 64 is attached to the outer circumferential surface of needle surrounding seal 60 so as to prevent the expansion of the outer diameter of seal 60. Movable bush 64 is L-shaped in cross-section taken in the radial direction and has a smaller diameter than the inner diameter of the innermost portion of ink supply portion 13. A fixed bush 65 is arranged inside the port surrounding seal 61. Fixed bush 65 is L-shaped in section to serve as a guide for inserting ink supply needle 50. Fixed bush 65 is mounted so that movable bush 64 is allowed to come in slidable contact with the innermost stepped portion 13a of supply port 13 in such a manner as to set port surrounding seal 61 into ink supply port 13 while insuring fixed bush 65 does not come into contact with needle surrounding seal 60.

Further, radially extending linear projections 66 are formed on the surface of movable bush 64 and are maintained in slidable contact with the innermost stepped portion 13*a* of ink supply port 13. A plurality of through holes 67 are formed between the linear projections 66, so that when the ink is injected with the inside of the cartridge evacuated to a negative pressure, the air within the packing member is allowed to escape to the outside of the selfaligning ring through holes 67 between the linear projections 66.

When the cartridge is inserted with an ink supply needle 50 aligned with an ink supply port 13, ink supply needle 50 pierces film 46 that seals ink supply port 13, and passes through film 46 into the through hole while being maintained in intimate contact with movable bush 64. Ink supply needle 50 is arranged so that tapered portion 51 thereof is allowed to go along the innermost portion of needle surrounding seal 60. In addition, thin-walled conical connecting ring 62 can be deformed to permit needle surrounding seal 60 and movable bush 64 to be displaced in the radial direction, so that the outer circumference of ink supply needle 50 is sealed without excessively deforming needle surrounding seal 60 itself. Needle surrounding seal 60 and bush 64 thus perform a self-alignment function.

Figure 7:
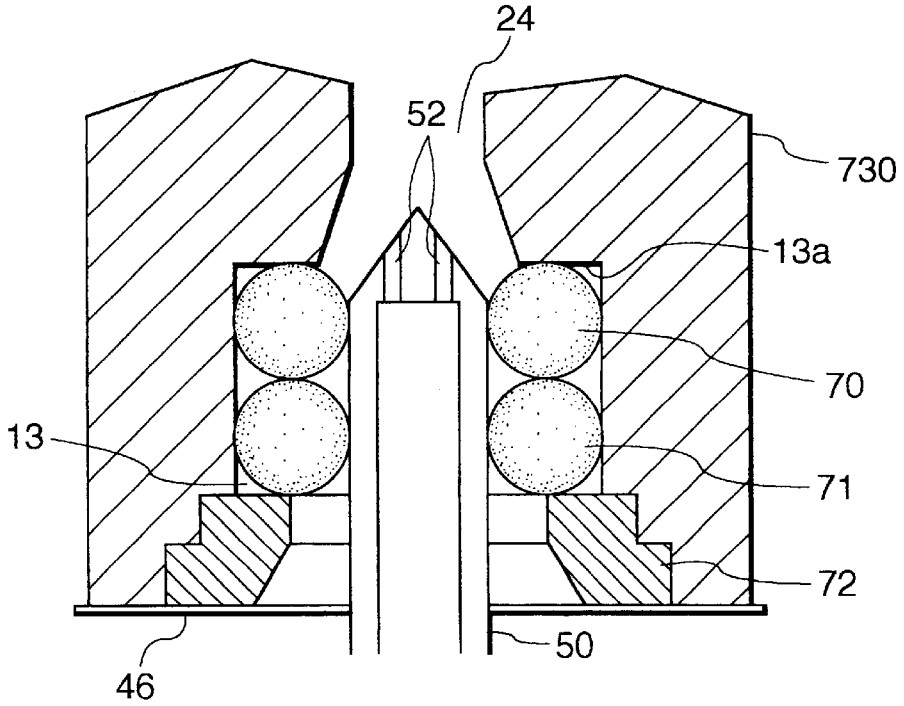

Reference is now made to FIG. 7 which depicts a packing member 730 for sealing ink supply needle 50 constructed in accordance with a third embodiment of the invention. Elements similar to those in the previous embodiments are given like reference numerals. Packing member 730 includes a first annular seal 70, a second annular seal 71, and a bush 72. Seal 70 has a circular cross-section and is an elastic member that abuts innermost stepped portion 13*a* of ink supply port 13. Seal 71 has a circular cross-section and is an elastic member that is located on the film 46 side of seal 70. Bush 72 is provided to fix these two seals 70 and 71 to ink supply port 13, with seals 70 and 71 being maintained in elastic contact with each other. The inner diameter of each of the two seals 70 and 71 is selected so as to be slightly smaller than the outer diameter of ink supply needle 50 and the outer diameter of each of the seals 70 and 71 is selected so as to be slightly larger than the inner diameter of ink supply port 13.

When the cartridge is pushed into position for use with ink supply port 13 of the cartridge aligned with ink supply needle 50, ink supply needle 50 pierces film 46 and passes through second seal 71 and first seal 70. Although part of the film 46 enters into ink supply port 13 while being biased by ink supply needle 50 at this instance, second seal 71 located on the lower side of first seal 70 blocks the upward movement of film 46. As a result, first seal 70 can reliably seal the circumference of the ink supply needle 50.

It will thus be seen that the objects set forth above, among those made apparent from the preceding description are efficiently obtained and, since certain changes may be made in carrying out the above method and in the constructions set forth without department from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. An ink cartridge for an ink jet printer, comprising:

a main body shaped to define an interior space and including a partition wall in said interior space defining an ink chamber and a foam chamber maintained in fluid communication with said ink chamber through a communication hole in said partition wall, said communication hole providing the sole access for fluid flow into and out of said ink chamber, said foam chamber defining a larger volume than said ink chamber, a portion of said main body defining said foam chamber having at least a plurality of walls;

an air vent formed in a first wall of said foam chamber;

an ink supply port formed in a second wall of said foam chamber;

a porous body accommodated within said foam chamber with a portion of said porous body confronting said ink supply port, said porous body having a volume larger than the volume of said foam chamber;

a removable seal for releasably closing access of said air vent to the exterior of said main body;

liquid ink in said ink chamber and absorbed in said porous body, the amount of ink in said ink chamber being less than the amount of ink absorbed in said porous body when said air vent removable seal is closed, at least a portion of the ink initially charged into said ink cartridge is charged into said porous body; and whereby said ink from said ink chamber is supplied via said porous body to said ink supply port for supply to said ink jet printer after said removable seal is opened.

2. The ink cartridge of claim 1, wherein at least a portion of said main body in the region of said ink chamber is formed of one of a transparent and translucent material to permit the amount of liquid ink in the ink chamber to be visually determined.

3. The ink cartridge of claim 1, further comprising:

an ink injecting throughhole and an exhausting throughhole formed in the region of said main body confronting said foam chamber; and a meandering groove formed in an outer surface of said main body and communicating with one of said throughholes and a seal member on said outer surface, said one of said throughholes, groove and seal member defining a passage between the exterior of said main body and said one throughhole and forming said air vent, said removable seal being positioned to releasably close a portion of said meandering groove spaced from said one of said throughholes.

4. The ink cartridge of claim 1, further comprising:

a packing member in said ink supply port dimensioned to receive an ink supply needle of said ink jet printer.

5. The ink cartridge of claim 4, wherein said packing member is formed as a funnel-shaped packing member made of an elastic material having a first opening and a second opening, the first opening facing the interior of the foam chamber and being wider than the second opening.

6. The ink cartridge of claim 5, wherein said packing member further comprises:

a cylindrical portion which is thick-walled and is supported by an inner surface of said ink supply port; and a tapered portion which is connected to said cylindrical portion through a thin-walled connecting portion.

7. The ink cartridge of claim 4, wherein said packing member is formed into a self-aligning seal including:

a first annular seal member whose inner diameter is slightly smaller than an outer diameter of said ink supply needle and whose inner diameter is smaller than the inner diameter of the adjacent portion of said ink supply port;

a second annular seal member whose outer diameter is slightly larger than the inner diameter of the adjacent portion of said ink supply port; and a thin-walled connecting member connecting said first and second seal members to each other, whereby said first annular seal member can be displaced laterally in said ink supply port.

8. The ink cartridge of claim 7, further comprising:

an annular movable bush being arranged on an outer circumferential surface of said first annular seal member serving to regulate expansion of said first annual seal member during insertion of said ink supply needle.

9. The ink cartridge of claim 7, further comprising:

a fixed bush arranged on an inner circumferential surface of said second annular seal member to fix said second annular seal member to the interior of said ink supply port.

10. The ink cartridge of claim 4, said packing member further comprising:

a bush disposed within said ink supply port;

a first annular seal member in contact with said bush; and a second annular seal member in contact with said first annular seal member and said ink supply port, each said seal member having an inner diameter slightly smaller than an outer diameter of the ink supply needle.

11. The ink cartridge of claim 1, further comprising:

a plurality of sets of said foam and ink chambers, each set of chambers consisting of a foam chamber and an ink chamber containing a different color ink, said sets of chambers being integrated into a single ink cartridge, each of said foam chambers containing one of said porous bodies.

12. The ink cartridge of claim 11, wherein at least a portion of said main body in the region of said ink chambers is formed of one of a transparent and a translucent material to permit the amount of liquid ink in the ink chamber to be visually determined.

13. The ink cartridge of claim 11, and including a projected portion of the ink supply port in each foam chamber which projects toward an inside of the foam chamber, said projected portion locally elastically biasing the porous body in the associated foam chamber in the vicinity of the distal end of said projected portion so that a compression in the vicinity of said ink supply port is locally increased.

14. The ink cartridge of claim 13, further comprising:

a projection for biasing each porous body onto the ink supply port formed on an inner wall of said foam chamber confronting the ink supply port.

15. The ink cartridge of claim 10, wherein said porous member is compressed in the region of said communication hole, said ink supply port being formed from a projecting member extending into said foam chamber and formed with an opening at its distal end for receipt of ink from said porous member, said projecting member being spaced from said communication hole a distance such that the compression of said porous member adjacent said communication hole is less than the compression of the porous member at the distal end of said projecting member and essentially gradually increases from said communication hole to the distal end of said projecting member.

16. The ink cartridge of claim 1, wherein said porous body and foam chamber are dimensioned so that at least the region of the foam body confronting said ink supply port is compressed to a greater extent than a region of the foam body not confronting said ink supply port.

17. ink cartridge of claim 16, wherein the porous member is compressed in the region of said communication hole, said ink supply port being formed from a projecting member extending into said foam chamber and formed with a opening at its distal end for receipt of ink from said porous member, said projecting member being spaced from said communication hole a distance such that the compression of said porous member adjacent said communication hole is less than the compression of the porous member at the distal end of said projecting member and essentially gradually increases from said communication hole to the distal end of said projecting member.

18. The ink cartridge of claim 17, wherein the distance between said projecting member and said communication hole is not less than 1.5 times the height of said projecting member.

19. The ink cartridge of claim 1, further comprising: a projecting portion of said ink supply port projecting inwardly into said foam chamber, the projecting portion having a distal end, one of said plurality of walls of said foam chamber facing the distal end of said projecting portion and being formed with projections extending into said foam chamber in a region essentially opposite said distal end.

20. The ink cartridge of claim 1, wherein said ink tank cartridge is of a single-use type.

21. The ink cartridge of claim 1, wherein the amount of ink in said ink chamber being less than the amount of ink absorbed in said porous body before initial removal of said air vent removable seal.

22. An ink jet recording apparatus for outputting ink onto a recording medium, comprising:

a recording head for ejecting ink; an an ink tank cartridge removably mountable onto said recording head of said ink jet recording apparatus for delivery of ink thereto, including:

a main body shaped to define an interior space and including a partition wall in said interior space defining an ink chamber and a foam chamber maintained in fluid communication with said ink chamber through a communication hole in said partition wall, said communication hole providing the sole access for fluid flow into and out of said chamber, said foam chamber defining a larger volume than said ink chamber, a portion of said main body defining said foam chamber having at least a plurality of walls;

an air vent formed in a wall of said first foam chamber;

an ink supply port formed in a wall of said second foam chamber;

a porous body accommodated within said foam chamber with a portion of said porous body confronting said ink supply port, said porous body having a volume larger than the volume of said foam chamber;

a removable seal for releasably closing access of said air vent to the exterior of said main body;

liquid ink in said ink chamber and absorbed in said porous body, the amount of ink in said ink chamber of ink being less than the amount of ink absorbed in said porous body when said air vent removable seal is closed, at least a portion of the ink initially charged into said ink cartridge is charged into said porous body; and whereby said ink from said ink chamber is supplied via said porous body to said ink supply port for supply to said recording head after said removable seal is opened.

23. The ink jet recording apparatus of claim 22, wherein at least a portion of said main body in the region of said ink chamber is formed of one of a transparent and a translucent material to permit the amount of liquid ink in the ink chamber to be visually determined.

24. The ink jet recording apparatus of claim 22, wherein said porous body and foam chamber are dimensioned so that at least the region of the foam body confronting said ink supply port is compressed to a greater extent than a region of the foam body not confronting said ink supply port.

25. The ink jet recording apparatus of claim 24, wherein the porous member is compressed in the region of said communication hole, said ink supply port being formed from a projecting member extending into said foam chamber and formed with an opening at its distal end for receipt of ink from said porous member, said projecting member being spaced from said communication hole a distance such that the compression of said porous member adjacent said communication hole is less than the compression of the porous member at the distal end of said projecting member and essentially gradually increases from said communication hole to the distal end of said projecting member.

26. The ink jet recording apparatus of claim 25, wherein the distance between said projecting member and said communication hole is not less than 1.5 times the height of said projecting member.

27. The ink jet recording apparatus of claim 22, further comprising:

an ink injecting throughhole and an exhausting throughhole formed in the region of said main body confronting said foam chamber; and a meandering groove formed in an outer surface of said main body and communicating with one of said throughholes and a seal member on said outer surface, said one of said throughholes, groove and seal member defining a passage between the exterior of said main body and said one throughhole and forming said air vent, said removable seal being positioned to releasably close a portion of said meandering groove spaced from said one of said throughholes.

28. The ink jet recording apparatus of claim 22, wherein said ink tank cartridge is of a single-use type.

29. The ink jet recording apparatus of claim 22, wherein the amount of ink in said ink chamber being less than the amount of ink absorbed in said porous body before initial removal of said air vent removable seal.

30. A system for supplying ink to an ink jet recording apparatus and outputting ink onto a recording medium, said system comprising:

a recording head for ejecting ink; and an ink tank cartridge removably mountable onto said recording head of said ink jet recording apparatus for delivery of ink thereto, including:

a main body shaped to define an interior space and including a partition wall in said interior space defining an ink chamber and a foam chamber maintained in fluid communication with said ink chamber through a communication hole in said partition wall, said communication hole providing the sole access for fluid flow into and out of said chamber, slid foam chamber defining a larger volume than said ink chamber, a portion of said main body defining said foam chamber having at least a plurality of walls;

an air vent formed in a wall of said first foam chamber;

an ink supply port formed in a wall of said second foam chamber;

a porous body being accommodated within said foam chamber with a portion of said porous body confronting said ink supply port, said porous body having a volume larger than the volume of said foam chamber;

a removable seal for releasably closing access of said air vent to the exterior of same main body;

liquid ink in said ink chamber and absorbed in said porous body, the amount of ink in said ink chamber being less than the amount of ink absorbed in said porous body when said air vent removable seal is closed, at least a portion of the ink initially charged into said ink cartridge is charged into said porous body; and whereby said ink from said ink chamber is supplied via said porous body to said ink supply port for supply to said recording head after said removable seal is opened.

31. The system of claim 30, wherein at least a portion of said main body in the region of said ink chamber is formed of one of a transparent and a translucent material to permit the amount of liquid ink in the ink chamber to be visually determined.

32. The system of claim 30, wherein said porous body and foam chamber are dimensioned so that at least the region of the foam body confronting said ink supply port is compressed to a greater extent than a region of the foam body not confronting said ink supply port.

33. The system of claim 32, wherein the porous member is compressed in the region of said communication hole, said ink supply port being formed from a projecting member extending into said foam chamber and formed with an opening at its distal end for receipt of ink from said porous member, said projecting member being spaced from said communication hole a distance such that the compression of said porous member adjacent said communication hole is less than the compression of the porous member at the distal end of said projecting member and essentially gradually increases from said communication hole to the distal end of said projecting member.

34. The system of claim 33, wherein the distance between said projecting member and said communication hole is not less than 1.5 times the height of said projecting member.

35. The system of claim 30, further comprising:

an ink injecting throughhole and an exhausting throughhole formed in the region of said main body confronting said foam chamber; and a meandering groove formed in an outer surface of said main body and communicating with one of said throughholes and a seal member on said outer surface, said one of said throughholes, groove and seal member defining a passage between the exterior of said main body and said one throughhole and forming said air vent, said removable seal being positioned to releasably close a portion of said meandering groove spaced from said one of said throughholes.

36. The system of claim 30, wherein said ink tank cartridge is of a single-use type.

37. The system of claim 30, wherein the amount of ink in said ink chamber being less than the amount of ink absorbed in said porous body before initial removal of said air vent removable seal.

38. An ink cartridge for an ink jet printer, comprising:

a main body shaped to define an interior space and including a partition wall in said interior space defining an ink chamber and a foam chamber maintained in fluid communication with said ink chamber through a communication hole in said partition wall, said communication hole providing the sole access for fluid flow into and out of said ink chamber, said foam chamber defining a larger volume than said ink chamber, a portion of said main body defining said foam chamber having at least a plurality of walls;

an ink supply port formed in a wall of said foam chamber;

a porous body accommodated within said foam chamber with a portion of said porous body confronting said ink supply port, said porous body having a volume larger than the volume of said foam chamber when manufactured;

liquid ink in said ink chamber and absorbed in said porous body, the amount of ink in said ink chamber being less than the amount of ink absorbed in said porous body at the time of completion of manufacture and before use of said ink cartridge, wherein at least a portion of the ink initially charged into said ink cartridge is charged into said porous body;

whereby ink from said ink chamber is supplied via said porous body to said ink supply port for supply to said recording head;

a packing member in said ink supply port dimensioned to receive an ink supply needle of said ink jet printer;

said packing member further comprising:

a bush disposed within said ink supply port;

a first annular seal member in contact with said bush; and a second annular seal member in contact with said first annular seal member and said ink supply port, each said seal member having an inner diameter slightly smaller than an outer diameter of the ink supply needle.

* * * * *